US007905239B2

(12) United States Patent
Kim

(10) Patent No.: US 7,905,239 B2
(45) Date of Patent: Mar. 15, 2011

(54) PART WASHER

(76) Inventor: Sung-Il Kim, Seoul (KR)

( * ) Notice: Subject to any disclaimer, the term of this patent is extended or adjusted under 35 U.S.C. 154(b) by 419 days.

(21) Appl. No.: 11/718,331

(22) PCT Filed: Oct. 29, 2005

(86) PCT No.: PCT/KR2005/003619

§ 371 (c)(1),
(2), (4) Date: Apr. 30, 2007

(87) PCT Pub. No.: WO2006/046842

PCT Pub. Date: May 4, 2006

(65) Prior Publication Data

US 2008/0087306 A1 Apr. 17, 2008

(30) Foreign Application Priority Data

Oct. 29, 2004 (KR) ..... 10-2004-0087360
Oct. 28, 2005 (KR) ..... 10-2005-0102492

(51) Int. Cl.
*B08B 3/02* (2006.01)

(52) U.S. Cl. ..... 134/95.2

(58) Field of Classification Search ..... 134/95.2
See application file for complete search history.

(56) References Cited

U.S. PATENT DOCUMENTS

| | | | | |
|---|---|---|---|---|
| 3,522,814 A | | 8/1970 | Olson | |
| 4,231,806 A | * | 11/1980 | Henry | 134/18 |
| 4,300,318 A | * | 11/1981 | Brown | 451/88 |
| 4,326,552 A | * | 4/1982 | Bleckmann | 134/99.1 |
| 5,143,102 A | * | 9/1992 | Blaul | 134/58 R |
| 5,398,708 A | * | 3/1995 | Sheldon | 134/86 |
| 5,496,531 A | * | 3/1996 | Davis et al. | 423/418.2 |
| 6,042,026 A | * | 3/2000 | Buehler, II | 239/346 |
| 6,128,438 A | * | 10/2000 | Kim | 392/447 |
| 6,308,899 B1 | * | 10/2001 | Crofford | 239/373 |
| 6,386,949 B1 | | 5/2002 | Hagiwara et al. | |
| 2003/0066907 A1 | * | 4/2003 | Drouillard | 239/284.1 |

FOREIGN PATENT DOCUMENTS

| | | |
|---|---|---|
| EP | 0824973 | 2/1998 |
| KR | 100256567 | 2/2000 |
| KR | 20-0255086 | 11/2001 |
| KR | 1020010095867 | 11/2001 |

* cited by examiner

*Primary Examiner* — Michael Barr
*Assistant Examiner* — Samuel A Waldbaum
(74) *Attorney, Agent, or Firm* — Park & Associates IP Law LLC

(57) ABSTRACT

An apparatus for cleaning an article comprises: a solution receptacle (12) for storing cleaning solution (100); a cleaning chamber (16) for receiving an article (P) to clean; a material transporting conduit including a solution conduit (14) connected between the solution receptacle and the cleaning chamber for transporting the cleaning solution from the solution receptacle to the cleaning chamber to apply to the article received in the cleaning chamber, the material transporting conduit further including an air conduit (44) connected to a high-pressure air source (42) for transporting the high-pressure air there-through and to apply to the article; and a heating device (30) coupled with the solution conduit (14) and the air conduit (44) for heating both the cleaning solution in the solution conduit and the high-pressure air in the air conduit concurrently and to a heated temperature prior to applying to the article.

13 Claims, 8 Drawing Sheets

PART WASHER

TECHNICAL FIELD

The present invention relates to a part washer for washing various parts using a cleansing solution, in particular to a part washer, which discharges the high-pressure air to be injected to the parts and the solution for cleansing the parts at the state where they are heated by means of heating means, and heats the high-pressure air moving at high velocity smoothly, thereby improving cleansing and drying efficiencies in comparison with a conventional art.

BACKGROUND ART

In general, a part washer is employed for cleansing various machinery parts used in a repair shop or in the several industrious field. Such a separate part washer is used in cleansing oil dusts and the like stained to the parts in the process of repairing and maintaining the machine. In operating such a conventional part washer, cleansing solution accommodated in a drum is at first discharged via a pump, and the parts are cleaned by using the cleansing solution. In this instance, users conventionally have removed the dirty materials by scrubbing the parts on which the cleansing solutions are stained with a brush and the like.

However, in case of such a general part washer having a simple function of discharging the cleansing solution, there is produced a problem that whole cleansing efficiency has been reduced because the temperature of the cleansing solution is lowered to thereby decrease the cleansing force of the cleansing solution at the cold winter season, and the cleansing solution is sprayed at such state.

In Korean patent application No. 10-1997-0082649, to solve such problem, there is disclosed a part washer, which can prevent the decrease of the cleansing force of the cleansing solution at the cold winter season by heating the cleansing solution to a proper temperature by using a separate heating device before it is sprayed to parts to be cleansed.

As shown in FIG. 1, the conventional part washer comprises: a drum for receiving the cleansing solution, a cleansing hose for guiding the cleansing solution in the drum so that it can be discharged to parts to be cleansed, a cleansing chamber for receiving the cleansing solution discharged via the cleansing hose and in which the parts to be cleansed are located, and a heating device installed at proper position of the cleansing hose for heating the cleansing solution being supplied via the cleansing hose.

When the cleansing work is performed by using the conventional part washer constructed as above, the cleansing solution in the drum at first is transported through the cleansing hose to pass the heating device installed at the cleansing hose. The cleansing solution is heated to a proper temperature by the generation of heat from the heating device installed at the cleansing hose during it passes through the heating device to thereby be discharged to parts to be cleansed.

Accordingly, in such conventional part washer, since the cleansing solution is sprayed to the parts when it is heated to a proper temperature, it is possible to prevent the decrease of the cleansing efficiency by the decrease of the temperature of the cleansing solution at the winter season.

However, in such conventional part washer, since there has not provided a separate drying device for drying the cleansing solution stained to the parts to be cleansed after the completion of the cleansing works, it is necessary for the users to clean the cleansing solution with a towel and the like or to dry it naturally.

As a result, there is produced a problem that whole working process for repairing and conserving the parts is delayed because drying work takes long time.

DISCLOSURE OF INVENTION

Technical Problem

The present invention has been made to solve the above-mentioned problems occurring in the conventional art, and the primary object of the present invention is to provide a part washer, in which the drying efficiency can be improved by heating the high-pressure air by means of an air injection means, which is installed for injecting the high-pressure air, to a proper temperature before it is discharged.

Further, another object of the present invention is to provide a part washer, in which the cleansing efficiency can be improved by increasing the discharge pressure of the cleansing solution via the high-pressure air injected from an air injection means.

Still another object of the present invention is to provide a part washer, in which the heating efficiency of the high-pressure air can be improved by facilitating the heating in spite of the high velocity transportation of the high-pressure air, by making the cleansing solution and the high-pressure air pass through the heating means via a separate tube.

Still another object of the present invention is to provide a part washer, in which the heating efficiency at the winter season can be improved by making the high-pressure air and the cleansing solution be heated concurrently.

Technical Solution

To achieve the above objects, the part washer of the present invention basically comprises:

cleansing means for cleansing parts to be cleansed by discharging the cleansing solution to the outside, and heating means for heating the cleansing solution before it is discharged to the parts so that the cleansing solution can be discharged at the heated state.

Further, according to the present invention, air injection means is also installed for emitting the high-pressure air into the outside in order to enhance the discharge pressure of the cleansing solution or to dry the cleansing solution stained on the parts, so that the high-pressure air injected from the air injection means as well as the cleansing solution can be heated by the heating means.

Advantageous Effects

As described above, according to the part washer of the present invention, it is possible to increase the cleansing and drying efficiency by heating the high-pressure air injected by means of an air injection means, which is installed for injecting the high-pressure air, to a proper temperature before it is discharged as has been the cleansing solution.

Further, it is also possible to further increase the cleansing efficiency by enhancing the discharge pressure by means of the high-pressure air injected from the air injection means.

Third, the part washer of the present invention is economical in comparison with the device employing a separate drying device because the drying process of the parts can be performed by simple operation of the valves after the completion of the cleansing, and it is also possible to reduce time required for the cleansing and drying works for the parts.

Next, it is possible to increase the heating efficiency of the high-pressure air by making the high-pressure air and the cleansing solution pass through the heating device via separate tube to thereby facilitate the heating of the air in spite of its high velocity transportation, Last, it is possible to increase the heating efficiency at the winter season by making the high-pressure air and the cleansing solution be heated concurrently, and it is also possible to reduce the time required for the cleansing and drying works.

BEST MODE FOR CARRYING OUT THE INVENTION

Figure 1:
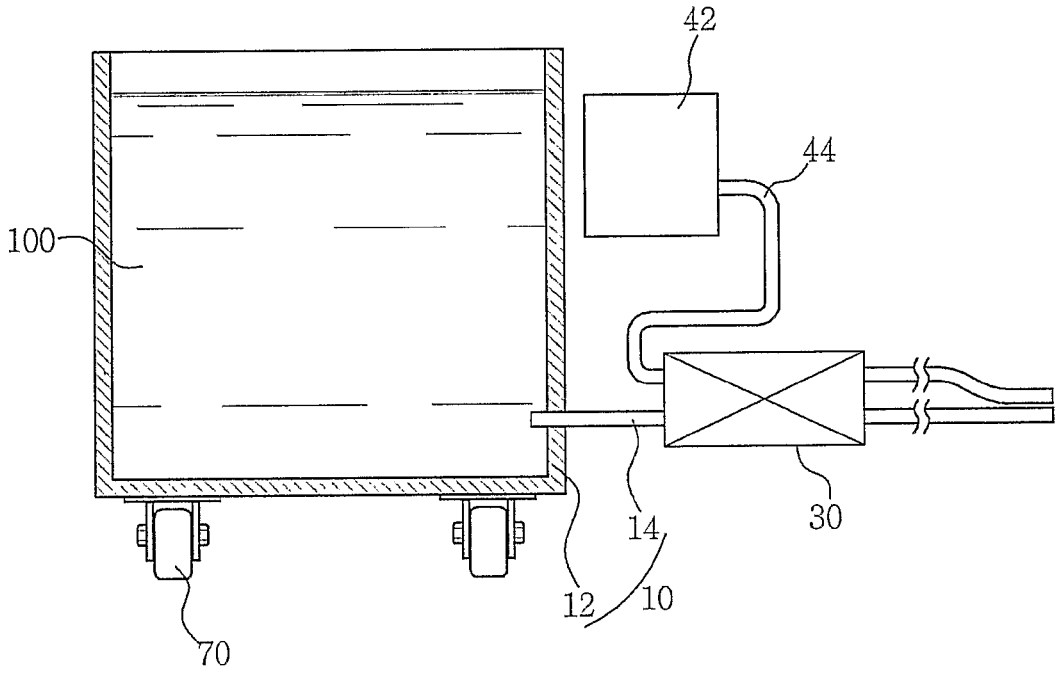
FIG. 1 is a cross-sectional view showing a basic construction of a part washer of the present invention.

To accomplish the above objects, the part washer of the present invention basically comprises:

cleansing means for cleansing parts to be cleansed by discharging the cleansing solution to the outside, and heating means for heating the cleansing solution before it is discharged to the parts so that the cleansing solution can be discharged at the heated state.

Further, according to the present invention, air injection means is also installed for emitting the high-pressure air into the outside in order to enhance the discharge pressure of the cleansing solution or to dry the cleansing solution stained on the parts, so that the high-pressure air injected from the air injection means as well as the cleansing solution can be heated by the heating means.

Hereinafter, the part washer of the present invention will be described in detail with reference to the appended drawings. In the drawings, the same reference numerals are used to designate the same or similar components through all the drawings, and so repetition of the description on the same or similar components will be omitted.

Figure 2:
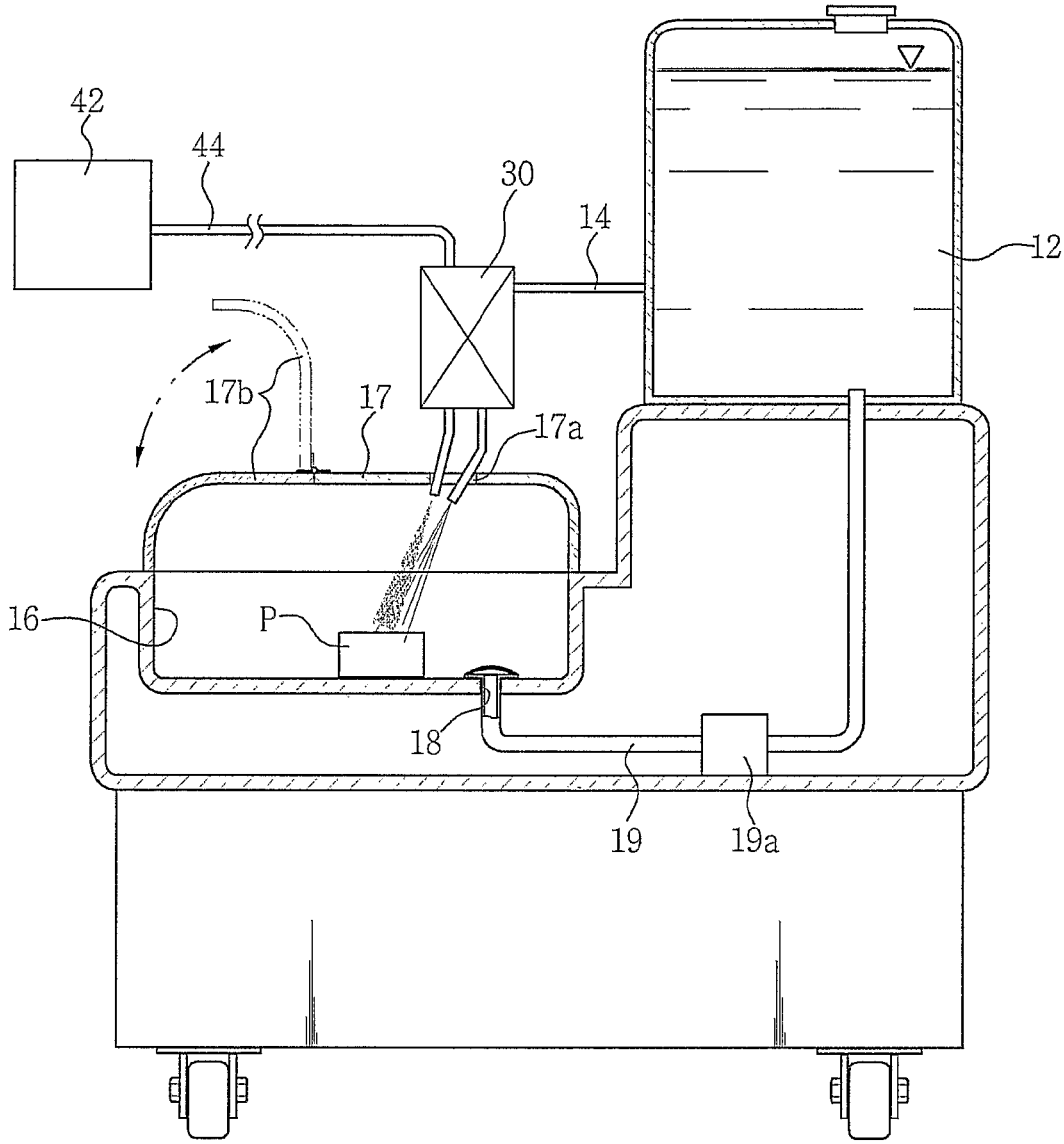
FIG. 2 is a cross-sectional view showing the connection structure between a drum and a cleansing chamber constituting the part washer of the present invention.
Figure 3:
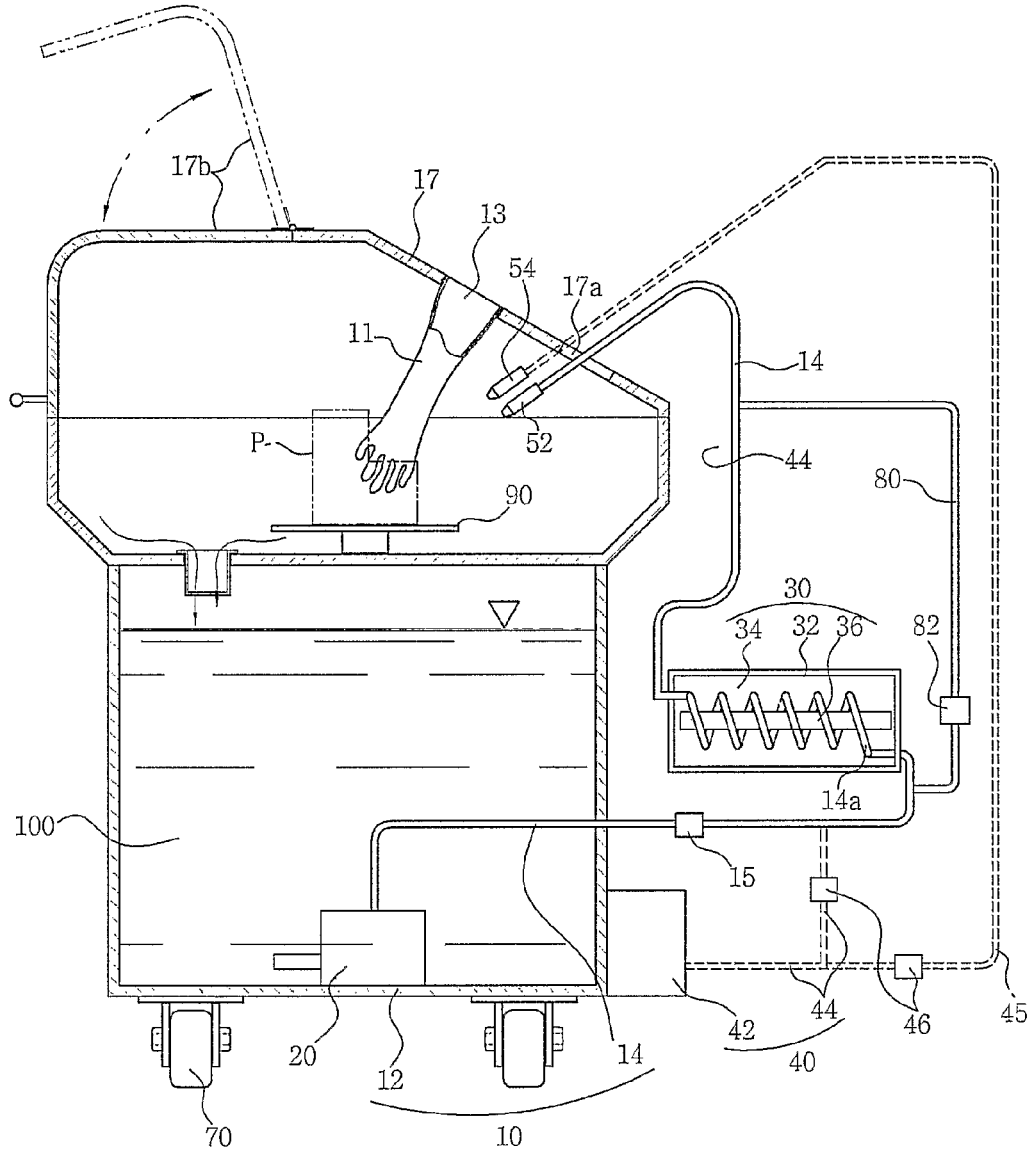
FIG. 3 is cross-sectional view showing the whole part washer of the present invention.
Figure 4:
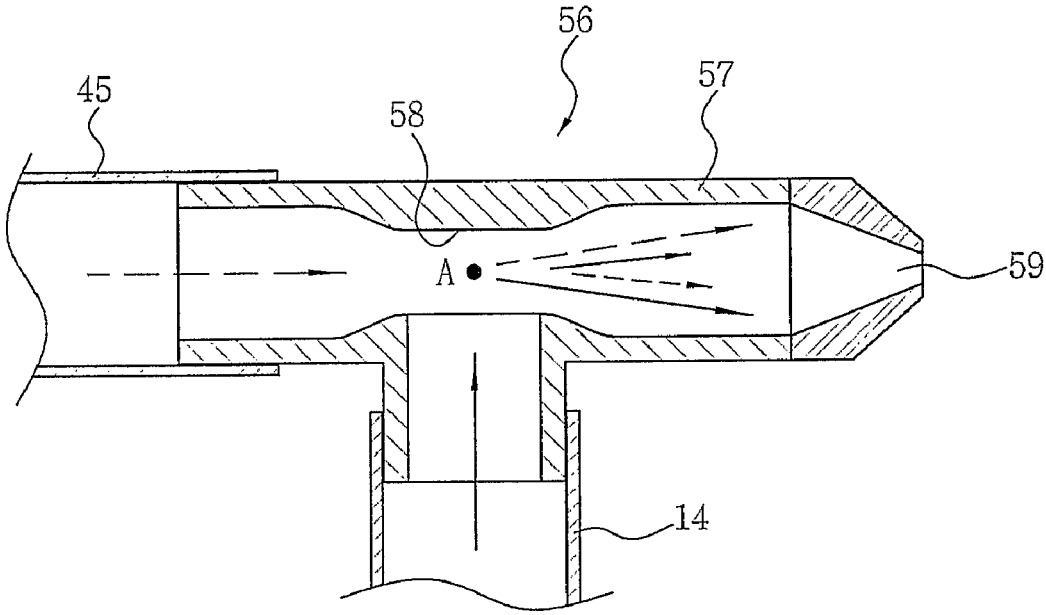
FIGS. 4 and 5 are schematic views showing shape of a venturi nozzle constituting the part washer of the present invention.

As shown in FIG. 2 to FIG. 4, the part washer according to the present invention principally comprises a cleansing means 10, a heating means 30, and an air injection means 40.

Referring now to FIG. 2, the cleansing means 10 comprises a drum 12 for receiving the cleansing solution, and a cleansing solution transporting pipe 14 for guiding the movement of the cleansing solution 100 accommodated in the drum 12.

The drum 12 having a proper size can be used depending on the working requirements, and is provided with wheels 70 at a bottom for facilitating the movement.

As for the cleansing solution 100, it can be selected based on the materials of the parts P or the types of the impurities stained on the machinery parts, and it is preferable to use volatile organic solvent such as a solvent, which can easily dissolve oil components, to remove the oil dirt and the like stained on the machinery parts.

Also, the drum 12 is provided with the cleansing solution transporting pipe 14 for transporting and discharging the cleansing solution 100 from the drum 12, which is fabricated of soft material which can be easily bent, so that the cleansing solution 100 can be sprayed from a various directions. Further, a first control valve 15 is provided at a predetermined position of the cleansing solution transporting pipe 14 for controlling the movement of the cleansing solution emitted from the drum 12.

The part washer 10 constructed as described above functions simply to discharge the cleansing solution to the outside, however, it does not equipped with functions of preventing the wash away of the cleansing solution or recovering and recycling the cleansing solution. Accordingly, as shown in FIG. 3 and FIG. 4, it is preferable to further install a cleansing chamber 16 for preventing the wash away of the cleansing solution and for recovering and recycling by injecting the cleansing solution in a sealed space.

As shown in FIG. 3, the cleansing chamber 16 is formed with a space for receiving the parts P to be cleansed, and is provided with a cover 17 at the upper portion, so that the wash away of the cleansing solution can be prevented in the process of the injection of the cleansing solution into the space.

Also, a through-hole 17*a* is formed at one side of the cover 17, into which respective one end of the transporting pipe 14 for the cleansing solution and a transporting pipe 44 for the high-pressure air can be inserted.

Further, the other side of the cover 17 is formed with an opening 17*b* for opening and closing to facilitate the charge and extraction of the parts P from the cleansing chamber 16.

In this instance, the opening 17*b* and the cover 17 are interconnected by means of a separate combustible connection member (not shown) and are configured to be supported by the connection member when the opening 17*b* has been opened, so that the opening 17*b* can be automatically closed by the combustion of the connection member supporting the opening 17*b* at the time of the combustion of the cleansing solution flowed into the cleansing chamber 16.

In addition, as shown in FIG. 4, a work-hole 13 can be formed at one side of the cleansing chamber 16 so that hands of the worker can be put into the cleansing chamber 16 to thereby facilitate the position change of the parts P or the change of the injecting direction of the cleansing solution during the operation of the device.

Concurrently, as shown in the drawings, the work-hole 13 is provided integrally with a separate glove 11 for preventing the hand of the worker from being directly stained of the cleansing solution to thereby protect the skin of the worker.

Additionally, the cleansing chamber 16 is provided with a rotation plate 90 at the inside bottom, which can be rotated with parts P being loaded thereon, to thereby facilitate the position change of the parts P at the time of cleansing the heavy parts.

Operators can directly rotate the rotation plate 90, although not shown in the drawings, or it can be rotated automatically by separate motor and operation button. In this regard, it is preferable that the operation button can be installed at a position where the worker can operate with foot, so that it is not necessary to frequently extract his hands from the cleansing chamber 16 to operate the button.

Further, the cleansing chamber 16 is formed with a discharge-hole 18 at the bottom for recovering the injected cleansing solution via the discharge-hole 18 into the drum 12. In this instance, as shown in FIG. 3, when the drum 12 is installed apart from the cleansing chamber 16 by a desired distance, the discharge-hole 18 of the cleansing chamber 16 is connected with the drum 12 via a separate circulation pipe 19.

Especially, when the drum 12 is positioned above the cleansing chamber 16, a separate circulation pump 19*a* is provided at the circulation pipe 19 to support smooth circulation of the cleansing solution.

When the cleansing chamber 16 is constructed that it is positioned above the drum 12, as shown in FIG. 4, to thereby make the cleansing solution be directly flowed into the drum 12 via the discharge-hole 18, the circulation pipe 19 and the circulation pump 19*a* will be removed.

When the cleansing chamber 16 is positioned above the drum 12, as shown in FIG. 4, the drum 12 is provided with a high-pressure emitting means 20 so that the cleansing solution in the drum 12 can be smoothly supplied to the cleansing chamber 16 above the drum 12.

The high-pressure emitting means 20 consists of a general pump, and is operated to emit the cleansing solution 100 stored in the drum 12 at a pressure in the range of 3 to 4 $kg/cm^2$ through the transporting pipe 14 for the cleansing solution to thereby spray it on the parts to facilitate removal of the dirt stained on the parts P by means of the injection pressure of the cleansing solution.

The transporting pipe 14 for the cleansing solution of the cleansing means 10, supplied from the drum 12 is arranged to pass through the heating means 30 installed separately, and is formed with a temperature adding portion 14*a* for the cleansing solution heated by the heating means 30 at a predetermined portion.

The heating means 30 is operated to heat the cleansing solution transported along the pipe 14 for transporting the cleansing solution, and the high-pressure air moved along the pipe 44 for transporting the high-pressure air. As shown in FIG. 4, the heating means includes a main body 32 in which the temperature adding portion 14*a* for the cleansing solution of the transporting pipe 14 for the cleansing solution is installed, thermal medium means 34 filled within the main body 32, and a heater 36 installed in the main body 32 for heating the thermal medium means 34.

The main body 32 is formed with a connection hole 32*a* at one side to which the transporting pipe 14 for the cleansing solution is connected, and a space in which the thermal medium means 34 and the heater 36 are installed.

The heater 36 is generally formed as a heat transferring wire heated by electric heating, and is connected to a separate temperature control means (not shown) to control the temperature so that it is not heated above the set temperature or is lowered below the set temperature.

Further, when the heater itself can be constructed by a heater having a positive temperature coefficient (PTC), in which the heat emitting amount is decreased according to the increase of the resistance when the surrounding temperature arises above any predetermined level, whereas the heat emitting amount will be increased according to the decrease of the resistance when the temperature is descended, it can be heated to any proper temperature without any separate sensor or controller, and can reduce the incidence of disorders.

Although the heater 36 can heat the cleansing solution by directly heating the temperature adding portion 14*a* for the cleansing solution of the transporting pipe 14 for the cleansing solution, it is preferable to heat the cleansing solution by indirectly transferring the heat to the cleansing solution via separate thermal medium means because the possibility of natural ignition of the cleansing solution to thereby outbreak fire is high, when the volatile material such as a solvent is used for the cleansing solution and is heated above a proper temperature.

The thermal medium means 34 is filled in the main body 32 to thereby be heated first by the heater 36, and as shown in FIG. 4, can be filled in the main body 32 as liquid form. In this instance, water or anti-freezing solution and the like can be used for the thermal medium means 34, and further highly purified materials such as base oil and the like can be used in consideration of the thermal stability, the range of the use temperature, and the thermal transferring coefficient.

Figure 5:
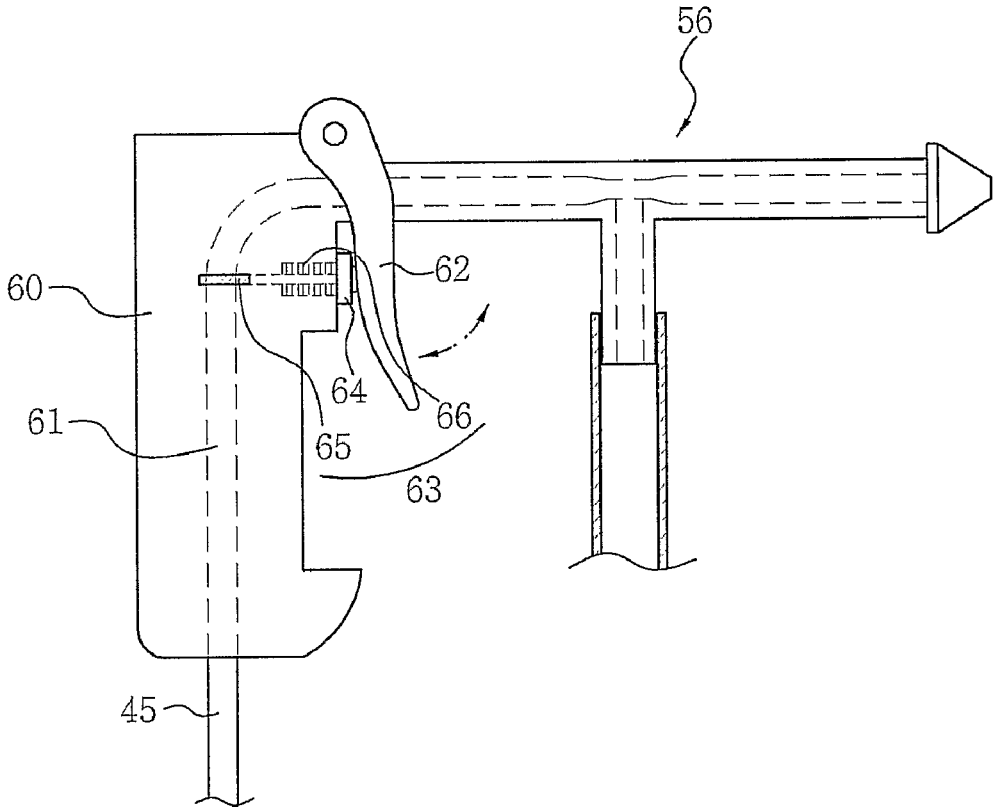

Also, the thermal medium means 34 can be embodied into a form that it is installed into the main body 32 as a metal form, and the temperature adding portion 14*a* of the cleansing solution of the transporting pipe 14 of the cleansing solution is installed within the metal form thermal medium means 34, as shown in FIG. 5, in addition to being embodied into the liquid form.

As for the metal form thermal medium means, metal having a good heat transfer coefficient such as an aluminium alloy can be employed.

When the heat 36 is embodied into the PTC element described above, the PTC element type heater can be filled in the main body without the separate thermal medium means, and the temperature adding portion 14*a* for the cleansing solution of the transporting pipe 14 for the cleansing pipe 14 can be configured that it is directly heated by the heater. In this instance, it is possible to prevent the fire outbreak due to the overheating or vaporization phenomena, because the cleansing solution is usually maintained at a proper temperature range based on the positive temperature coefficient characteristic, of the PTC element although the temperature adding portion 14*a* of the cleansing solution is directly heated.

The temperature-adding portion 14*a* passing through the heating means 30 constructed as described above can be constructed and installed integral with the transporting pipe 14 for the cleansing solution, or both ends of the temperature adding portion can be fabricated to be separated from the transporting pipe 14 for the cleansing solution and be installed within the heating means 30, and be connected to the transporting pipe 14 for the cleansing solution through separate assembly.

In this instance, the temperature-adding portion 14*a* for the cleansing solution is formed to be a coil form in the heating means 30 to thereby increase the heat transferring area so that the heating efficiency can be enhanced.

Further, it can be constructed that one end of the transporting pipe 14 for the cleansing solution passing through the heating means 30 be inserted into the through-hole 17*a* formed at the cleansing chamber 16 so that it can be positioned in the cleansing chamber 16.

If it is not necessary to heat the cleansing solution as is in the summer season, it can be constructed that separate auxiliary cleansing pipe 80 be installed so that the cleansing solution can be transported directly to the cleansing chamber 16 without passing through the heating means 30. The auxiliary cleansing pipe 80 is connected at one end to a portion formed between the drum 12 of the transporting pipe 14 for the cleansing solution and the heating means 30, and is connected to a portion extended from the heating means 30 of the transporting pipe 14 for the cleansing solution at the other end.

In this instance, as the auxiliary cleansing pipe 80 is installed so that it does not pass through the heating means 30, the cleansing solution discharged from the drum 12 can be directly transported to an injection nozzle without being heated.

Further, a separate second control valve 82' is installed at a connection portion between the auxiliary cleansing pipe 80 and the transporting pipe 14 for the cleansing solution to thereby control the transporting direction of the cleansing solution transported to the heating means 30 or to the auxiliary cleansing pipe 80.

Also, a separate injection nozzle 52 is installed at one end of the transporting pipe 14 for the cleansing solution as constructed above, so that the cleansing force can be enhanced by injecting the cleansing solution at high-pressure condition when the cleansing solution is discharged into the cleansing chamber 16.

The cleansing solution injected via the injection nozzle 52 while maintaining the predetermined pressure can be injected at a pressurized state by means of the high-pressure air injected by the separate air injection means 40, and the cleansing solution stained on the parts can be dried by means of the air injection means 40.

As shown in FIG. 4, the air injection means 40 includes a compression means 42 for compressing the air to a high-pressure and emitting it, and transporting pipe 44 for the high-pressure air for guiding the movement of the high-pressure air emitted from the compression means 42.

The compression means 42 is constructed of a general compressor, which is selected to have proper output in consideration of the compression and emission volume of the air.

The transporting pipe 44 for the high-pressure air is connected to the compression means 42 at one end and is connected to a portion positioned between the drum 12 of the transporting pipe 14 for the cleansing solution and the heating means 30 at the other end to thereby communicate the transporting pipe 14 for the cleansing solution.

In this instance, a third control valve 46 is installed at a connection portion of the transporting pipe 44 for the high-pressure air to the transporting pipe 14 for the cleansing solution to control the in-flow of the high-pressure air into the transporting pipe 14 for the cleansing solution.

As shown in the drawings, the third control valve 46 can be installed at the transporting pipe 44 for the high-pressure air, and it is installed at a connection portion of the transporting pipe 14 for the cleansing solution to the transporting pipe 44 for the high-pressure air to thereby control the flow of the cleansing solution and the high-pressure air concurrently at one operation.

By connecting the transporting pipe 44 for the high-pressure air to the transporting pipe 14 for the cleansing solution, the high-pressure air injected from the air injection means can be in-flowed into the transporting pipe 14 for the cleansing solution via the transporting pipe 44 for the high-pressure air to thereby be discharged to the outside after being heated by the heating means 30.

In other words, the high-pressure air in-flowed into the heating means 30 passes through the temperature adding portion 14*a* for the cleansing solution positioned inside of the heating means 30 to thereby be heated to a proper temperature during the process.

Also, another auxiliary pipe 45 for the high-pressure air is connected to the transporting pipe 44 for the high-pressure air for enhancing the injection pressure of the cleansing solution by injecting the cleansing solution and the high-pressure air concurrently or if it is not necessary to heat the high-pressure air, as the auxiliary pipe 80 for the cleansing solution is connected to the transporting pipe 14 for the cleansing solution.

The auxiliary pipe 45 for the high-pressure air can be connected to a desired position of the transporting pipe 44 for the cleansing solution at one end, and the other end of the pipe is positioned at the inside of the cleansing chamber 16 so that the high-pressure air discharged from the compression means can be transported into the cleansing chamber 16 directly via the transporting pipe 14 for the cleansing solution without passing through the heating means 30.

In this instance, the end of the auxiliary pipe 45 for the high-pressure air positioned inside of the cleansing chamber 16 can be provided with a separate injection nozzle 54 so that the high-pressure air can be injected with stronger pressure.

Also, in this instance, it can be constructed that an injection opening of the injection nozzle 54 installed at the auxiliary pipe 45 for the high-pressure air is positioned adjacent to an injection opening of the injection nozzle 52 installed at the transporting pipe 14 for the cleansing solution, so that the cleansing solution can be injected to the parts P with very high velocity by means of the high-pressure air concurrently with the discharging of the cleansing solution, when the cleansing solution and the high-pressure air are discharged at the same time.

Also, the injection nozzle can be separately installed at the auxiliary pipe 45 for the high-pressure air and the transporting pipe 14 for the cleansing solution as described above, one side of the injection nozzle can be connected to the auxiliary pipe 45 for the high-pressure air and the other side of it can be connected to the transporting pipe 14 for the cleansing solution to thereby make the cleansing solution be injected from one injection nozzle 56 at the mixed state.

In this case, the injection nozzle 56 is formed with a section reducing portion 58 at a portion connected to the transporting pipe 14 for the cleansing solution, and a venturi nozzle 57 can be employed so that the cleansing solution 100 in the drum 12 can be easily transported to the injection nozzle by the pressure differential produced when the high-pressure air passes through the section reducing portion 58.

In other words, if the fluid is supposed to be an air, the high-pressure air emitted from the compression means 42 can flow through the section reduction portion 58 of the venture nozzle 57 at high velocity to define low pressure at the section reducing portion 58. This flow can be represented by the equation 1 as follows according to the Bernoulli equation.

$$\frac{P_A}{\rho} + \frac{V_A^2}{2} + gH_A = \frac{P_B}{\rho} + \frac{V_B^2}{2} + gH_B = const \tag{1}$$

In other words, if it is supposed that the potential energy head H and the density ρ of the air are constant, the sum of the pressure head and the velocity head of the fluid at the respective point in the flow path is always maintained to be constant according to the Bernoulli equation. Accordingly, if the velocity of the air passing through the section reduction portion 58 of the venturi nozzle 57 is increased at the point A, the pressure will decrease corresponding to the velocity of the air. As a result, the pressure at the point A becomes lower than that of the point B.

In this regard, the fluid such as the cleansing solution and the like at the point B can be sucked into the point A and be transported by means of the pressure difference produced between the both points.

Herein, one side of the section reduction portion 58 of the venture nozzle 57 is connected to the transporting pipe 14 for the cleansing solution, and the rear end of the venture nozzle 57 is connected to the auxiliary pipe 45 for the high-pressure air. Then, the point A is positioned at an identical line with the one end of the transporting pipe 14 for the cleansing solution, and the point B is positioned at an identical line with an injection opening 59 of the venture nozzle 57.

Accordingly, the cleansing solution 100 stored in the drum 12 can be injected at high-pressure through the injection opening 59 of the venturi nozzle 57 with mixed into the high-pressure air emitted at high velocity after it has been sucked into the venturi nozzle 57 along the transporting pipe 14 for the cleansing solution.

When the cleansing solution is easily transported to the injection nozzle by the pressure differentials produced in the venture nozzle 57, the high-pressure emitting means 20 for emitting the cleansing solution form the inside of the drum 12 to the dismal end of the transporting pipe 14 for the cleansing solution can be abridged.

Figure 6:
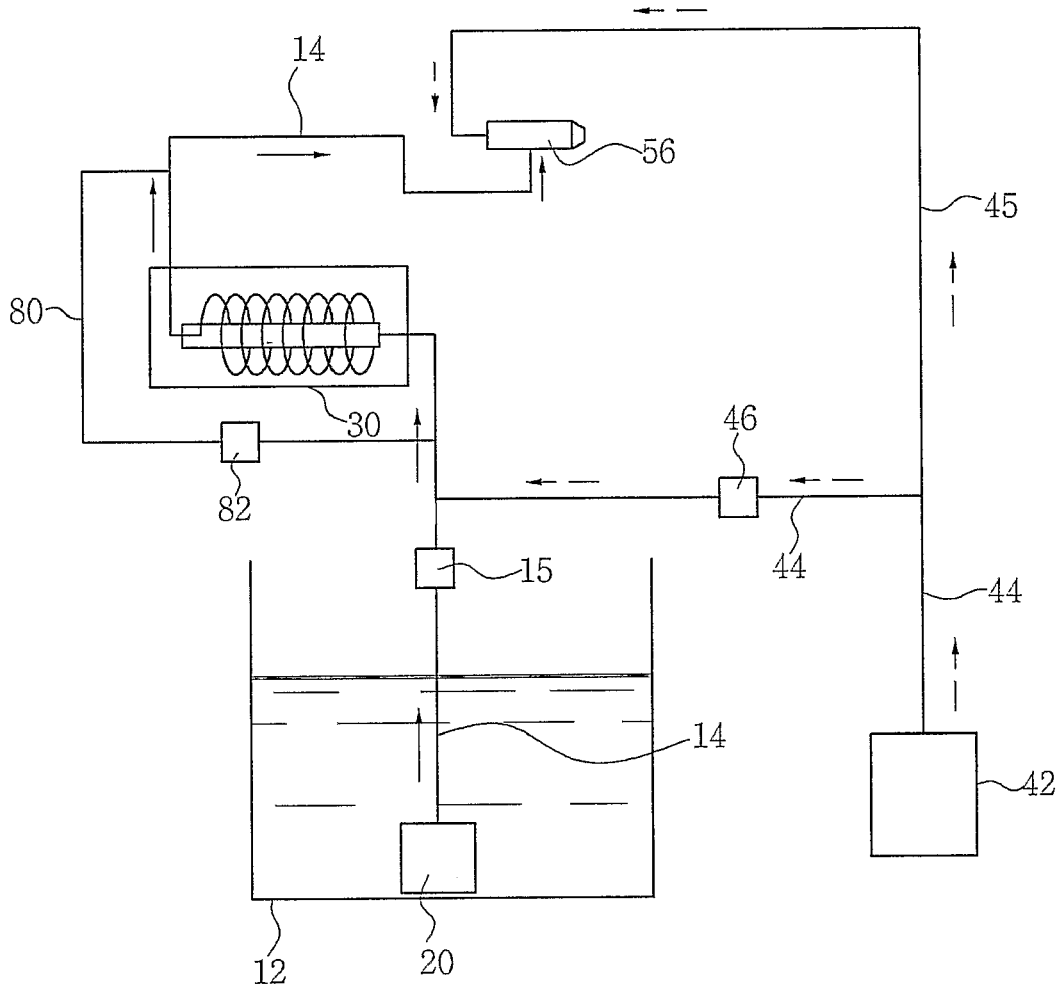
FIG. 6 is a schematic view showing the transporting and heating processes of the cleansing solution and the high-pressure air according to the present invention.

Also, as shown in FIG. 6, the venturi nozzle 57 can be constructed as a dry type so that the user can easily use it.

In other words, the venture nozzle 57 is provided with a handle 60 at the rear end, and a flow path 61 connected to the auxiliary pipe 45 for the high-pressure air is formed along an inside of the handle 60.

Further, a lever 62 is provided at one side of the handle 60 so that the high-pressure air discharged from the auxiliary pipe 45 for the high-pressure air can be selectively in-flowed into the venturi nozzle 57 when the user pulls the lever 62. In this regard, a shut-off device 63 is provided at the rear side of the lever 62 for selectively shutting-off the flow path communicating the venturi nozzle 57 with the auxiliary pipe 45 for the high-pressure air so that the high-pressure air can be selectively in-flowed into the venturi nozzle 57.

Here, the shut-off device 63 includes a supporting bar 64 connected to the rear side of the lever 62, a sealing member 65 installed at the dismal end of the supporting bar 64 for selectively shutting off the flow path, and a spring 66 for elastically supporting the bar 64.

Depending on such construction, if the user pulls the lever 62, the flow path 61 is closed, and on the contrary, if the lever 62 is released, the flow path 61 is opened.

The shut-off device 63 is not limited to such construction, and it can be fabricated of a general valve or a solenoid valve so that it can be operated manually or by automatic control using a mycom.

As described above, because the cleansing solution and the high-pressure air are injected at high velocity through the separate injection nozzle, the dirt stained on the parts can be easily removed, although the user scrubs the parts with a separate brush.

The present invention features that the injection nozzle is embodied into the venturi nozzle to thereby make the injection pressure of the cleansing solution be increased by the simple pressure change produced in the venturi nozzle.

Hereinafter, the operation and effect of the part washer according to the embodiment of the present invention will be described.

Figure 7:
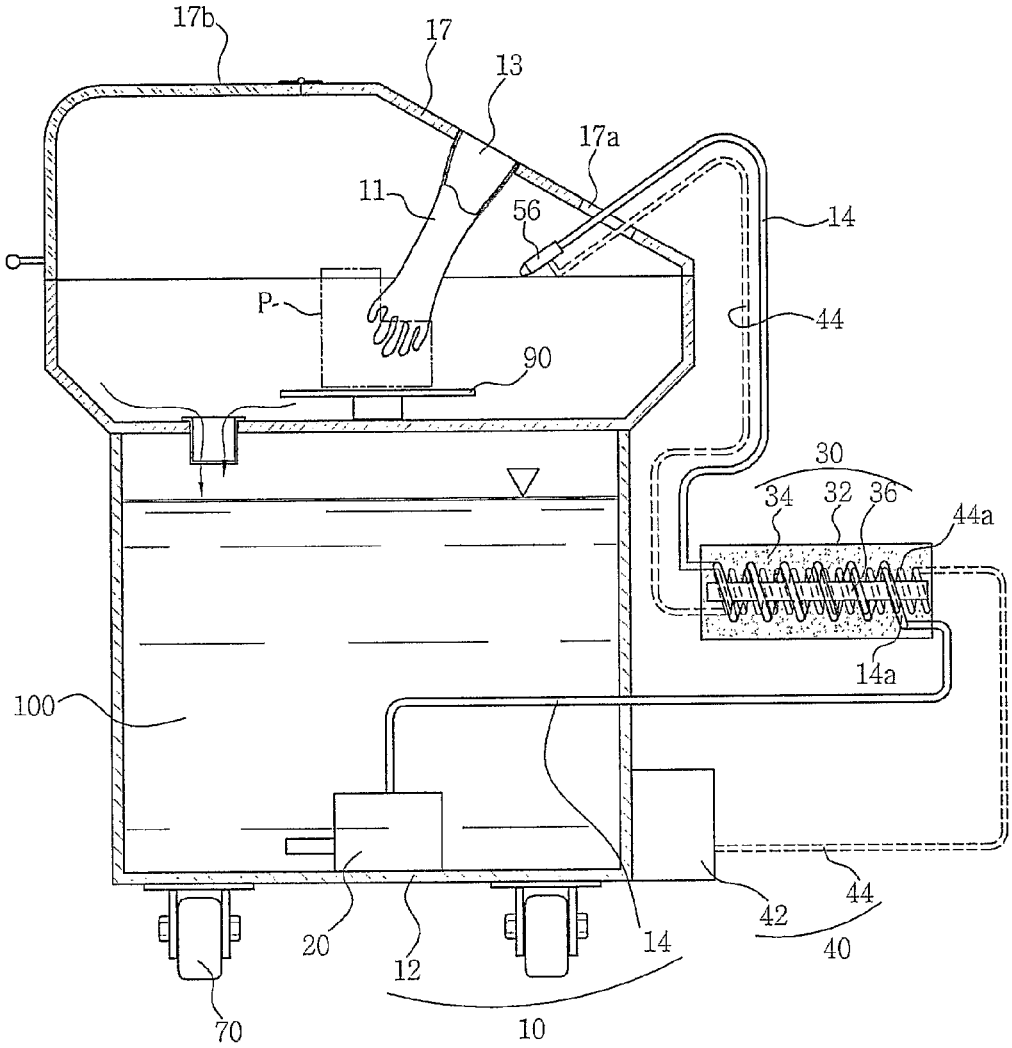
FIG. 7 is a cross-sectional view for showing the whole part washer of the present invention.

First of all, when the cleansing work is performed in the winter season, as shown in FIG. 7, the cleansing solution 100 stored in the drum 12 is emitted and transported along the transporting pipe 14 for the cleansing solution, if the high-pressure emitting device 20 installed in the drum 12.

Then, the transported cleansing solution passes through the temperature adding portion 14*a* for the cleansing solution installed in the heating means 30. In this instance, the heater 36 of the heating means 30 is operated to heat the thermal medium means 34 in the main body 32 to a predetermined temperature at first, and the heated thermal medium means 34 heats the cleansing solution by heat exchanging with the cleansing solution passed through the temperature adding portion 14*a* for the cleansing solution.

In such a heating process, because the temperature adding portion 14*a* for the cleansing solution in the main body 32 of the heating means 30 is configured as a coil, the transporting distance of the cleansing solution in the heating means 30 is extended to be long enough to heat the cleansing solution to a proper temperature.

The cleansing solution discharged from the heating means 30 at such a state where it is heated to a proper temperature is continuously transported along the transporting pipe 14 for the cleansing solution to thereby be injected to the parts P through the injection nozzle.

If it is required to increase the injection pressure of the cleansing solution, it is necessary to inject the cleansing solution and the high-pressure air. In this instance, if the compression means is operated during the injection process of the cleansing solution, high-pressure air is emitted and is transported to the cleansing chamber 16 along the transporting pipe 44 for the cleansing solution.

However, in this instance, it is required to operate the third control valve 46 installed in the transporting pipe 44 for the cleansing solution to thereby shut off the inflow of the high-pressure air into the transporting pipe 14 for the cleansing solution and allow the high-pressure air to flow along the auxiliary pipe 45 for the high-pressure air.

The high-pressure air transported along the auxiliary pipe 45 for the high-pressure air is mixed with the cleansing solution in the venturi nozzle and is injected to the parts. The injection pressure of the cleansing solution increases together with the increase of the flow velocity of the high-pressure air.

If it is not required to heat the cleansing solution as is in the summer season, the inflow of the cleansing solution discharged from the drum 12 into the heating means 30 is shut off by operating the second control valve 82 installed at the transporting pipe 14 for the cleansing solution and the auxiliary cleansing pipe 80. Accordingly, the cleansing solution discharged from the drum 12 can be transported via the auxiliary pipe 45 for the high-pressure air to the injection nozzle and discharged without passing through the heating means 30.

After completing such cleansing work, the drying work is performed to dry the cleansing solution stained on the parts.

The drying work is only performed by injection of the high-pressure air. In this regard, the first control valve 15 installed to the transporting pipe 14 for the cleansing solution is operated to prevent the movement of the cleansing solution to the injection nozzle, and emit the high-pressure air at this state to thereby make the high-pressure air to be transported along the auxiliary pipe 45 for the high-pressure air and be injected.

In this instance, although the venturi nozzle has been used for the injection nozzle, only high-pressure air is injected because the cleansing solution has been shut-off by the first control valve 15.

If it is required to discharge the high-pressure air after heating it in order to increase the dry efficiency in case of the winter season, the first control valve 15 is at first operated to shut-off the flow of the cleansing solution to the heating means 30, and the third control valve 46 is operated to make the high-pressure air be in-flowed into the transporting pipe 14 for the cleansing solution through the transporting pipe 44 for the high-pressure air.

Then, the emitted high-pressure air flows along the transporting pipe 44 for the high-pressure air into the transporting pipe 14 for the cleansing solution and to the heating means 30.

The high-pressure air in the heating means 30 is heated to a proper temperature during the passage through the temperature adding portion 14*a* for the cleansing solution, and is discharged to the outside through the injection nozzle.

According to one of the great features of the present invention described above, it is possible to increase the dry efficiency of the parts and reduce the dry work time by discharging the cleansing solution as well as the high-pressure air at the heated state.

Figure 8:
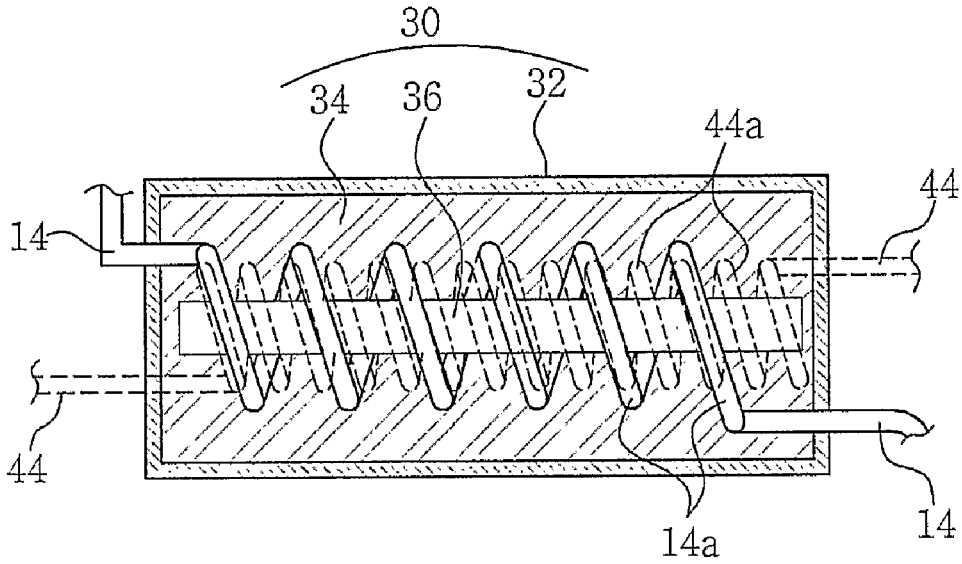
FIG. 8 is a cross-sectional view showing the installment structure of a temperature-adding portion for the cleansing solution and a temperature-adding portion for the high-pressure air provided in the heating device of the present invention.
Figure 9:
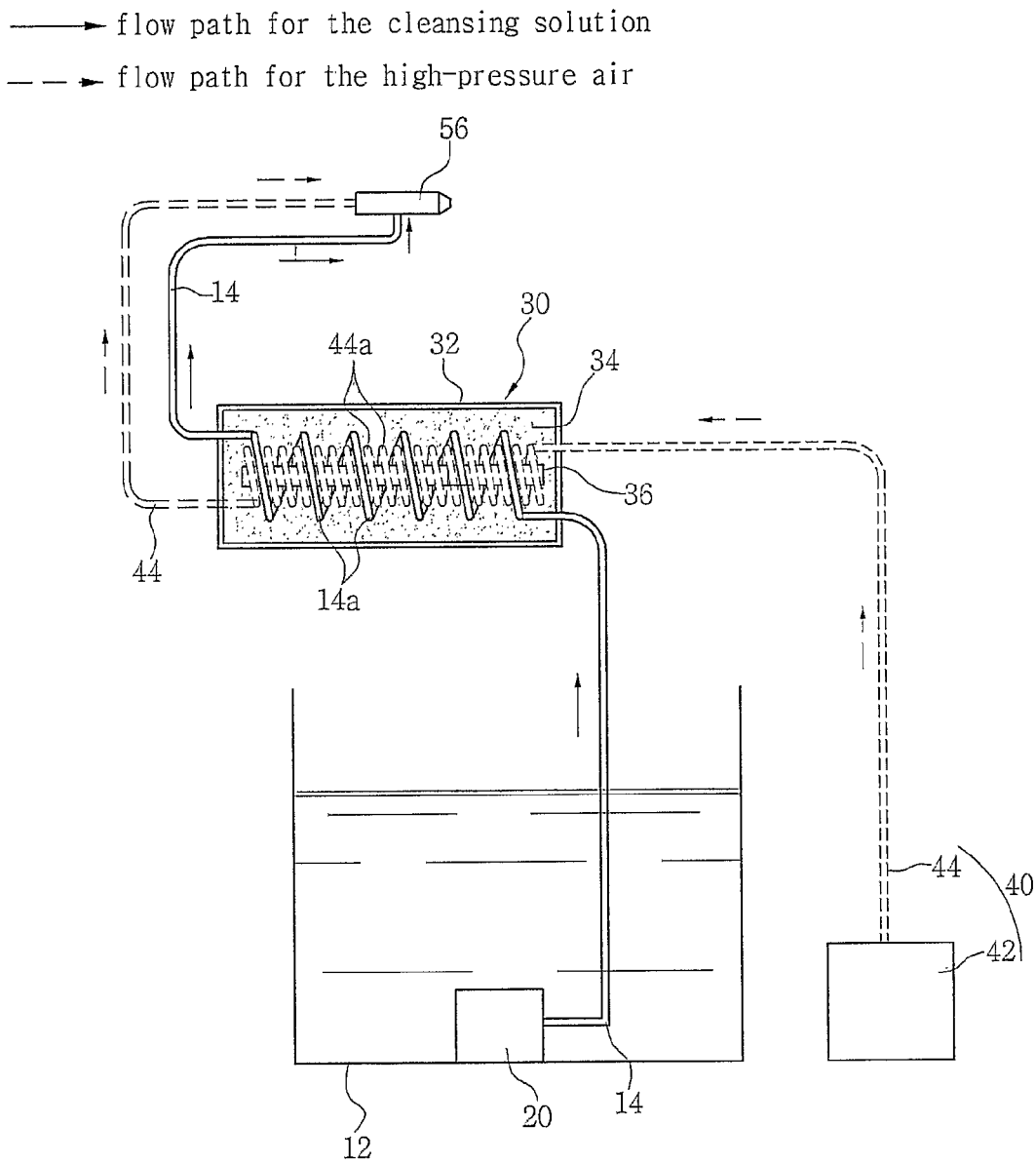
FIG. 9 is a schematic view showing the transporting and cleansing processes of the cleansing solution and the high-pressure air.

The structure of the present invention described above can be performed after it is changed variously, and FIGS. 8 to 10 are views showing other embodiments of the present invention.

In such other embodiments of the present invention, the whole structure is identical in that the cleansing solution as well as the high-pressure air can be heated, however, such embodiments feature that the cleansing solution and the high-pressure air can be separately heated by means of the heating means 30 after passing through the respective transporting pipe by constructing the transporting pipe for the cleansing solution and the transporting pipe for the high-pressure air be separately connected to the heating means 30.

As shown in FIG. 8, the transporting pipe 44 for the high-pressure air is configured to be connected to the compression means 42 at one end and be connected to the inside of the cleansing chamber 16 through the through-hole 17*a* of the cleansing chamber 16 at the other end.

In this regard, the transporting pipe 44 for the high-pressure air extended from the compression means is not connected to the transporting pipe 14 for the cleansing solution at one end, but is installed separately from the transporting pipe 14 for the cleansing solution and is positioned inside of the cleansing chamber 16.

In this instance, a portion of the transporting pipe 44 for the high-pressure air is installed to pass through the heating means 30 as is the transporting pipe 14 for the cleansing solution, so that the high-pressure air can be heated to a proper temperature when it is transported along the transporting pipe 44 for the high-pressure air.

As it has been constructed that the transporting pipe 44 for the high-pressure air passes through the heating means 30, a temperature adding portion 44*a* for the high-pressure air is formed at a portion in the transporting pipe 44 for the high-pressure air heated by the heating means 30.

As shown in FIG. 9, the temperature adding portion 14*a* for the cleansing solution and the temperature adding portion 44*a* for the high-pressure air are concurrently formed in the heating means 30 separately from each other.

In other words, the temperature adding portion 44*a* for the high-pressure air is formed to be in contact with the thermal medium means 34 in the heating means 30 as is the temperature adding portion 14*a* for the cleansing solution, however, it is installed separately from the temperature adding portion 14*a* for the cleansing solution so that it is not communicated with the temperature adding portion 14*a* for the cleansing solution and the high-pressure air can move along the transporting path separated from the cleansing solution.

Also, since the temperature adding portion 44*a* for the high-pressure air is configured as a coil shape in the heating means 30, it is possible to extend the transporting distance of the high-pressure air in the heating means 30 to thereby enlarge the heat transferring area.

In this instance, as the high-pressure air discharged from the compression means 42 can move at very high velocity in comparison with the cleansing solution, the temperature adding portion 44*a* for the high-pressure air is fabricated as a coil shape having more turns than the coil for the temperature adding portion 14*a* for the cleansing solution, so that it is possible to extend the transporting distance of the high-pressure air in the heating means 30 sufficiently to thereby heat the high-pressure air to a proper temperature smoothly.

As described above, as it has been constructed that the high-pressure air and the cleansing solution can be heated by the separate temperature adding portions 14*a*, 44*a* in the heating means 30, it is possible to prevent the fire outbreak or the vaporization of the cleansing solution due to the overheat, when the heat transferring area of the temperature adding portion 44*a* has been enlarged to heat the high-pressure air smoothly, and it is possible to concurrently heat the cleansing solution and the high-pressure air differently from the embodiment described above.

For reference, as for the temperature adding portion 44*a* for the high-pressure air and the temperature adding portion 14*a* for the cleansing solution according to the present embodiment in addition to the temperature adding portion 14*a* for the cleansing solution according to the above described embodiment of the present invention, they can be formed into various shapes including the coil shape, in so far as they can enlarge the heat transferring area in the main body 32.

Further, according to the present embodiment of the invention, separate injection nozzles can be installed at the outlet portions of the transporting pipe 44 for the high-pressure air and the transporting pipe 14 for the cleansing solution, and also it is possible to inject the high-pressure air and the cleansing solution at the mixed state by using the venturi nozzle.

When the cleansing work is carried out according to the embodiment of the present invention as constructed above, the transporting and heating processes of the cleansing solution are performed identically with the embodiment described above.

If it is required to inject high-pressure air to increase the injection pressure of the cleansing solution in the course of the cleansing work, as shown in FIG. 10, the high-pressure air emitted from the compression means 42 is flowed along the transporting pipe 44 for the high-pressure air to be heated to a proper temperature during the passage through the temperature adding portion 44*a* in the heating means 30.

In this instance, since the temperature adding portion 44*a* for the high-pressure air has been installed separately from the temperature adding portion 14*a* for the cleansing solution, the high-pressure air in-flowed into the heating means 30 is transported and heated separately from the cleansing solution.

Also, the high-pressure air is heated, as was in the cleansing solution, by the heat exchanging with the thermal medium means 34 heated by the heater 36.

Further, since the temperature adding portion 44*a* for the high-pressure air is configured as a coil shape, as is the temperature adding portion 14*a* for the cleansing solution, and is configured to have more turns than that of the temperature adding portion 14*a* for the cleansing solution in consideration of the transporting velocity of the high-pressure air, it is possible to extend the transporting distance to thereby heat the high-pressure air to a proper temperature smoothly.

The high-pressure air heated by the heating means 30 as such flows continuously along the transporting pipe 44 for the high-pressure air to be injected through the injection nozzle.

In this instance, if the injection nozzles have been installed separately for the respective transporting pipes 14, 44, the injection nozzle 54 for the high-pressure air can be installed adjacent the injection nozzle 52 for the cleansing solution to thereby inject the cleansing solution strongly with the injected high-pressure air.

Further, if it has been constructed that the venturi nozzle is adapted to inject the high-pressure air and the cleansing solution concurrently, the high-pressure air and the cleansing solution are mixed in the injection nozzle and injected at the mixed state.

It is possible to prevent the urgent reduction of the temperature in the atmosphere when the heated cleansing solution is injected at the winter season, by constructing that the high-pressure air can be injected together with the cleansing solution at the heated state in the course of the cleansing work.

It is the greatest feature of the present embodiment that it is possible to heat the cleansing solution and the high-pressure air at the same time to thereby prevent the reduction of the temperature of the injected cleansing solution in the winter season and to increase the drying efficiency, by constructing the part washer of the present invention that the transporting pipe 14 for the cleansing solution and the transporting pipe 44 for the high-pressure air can pass through the heating means 30 separately to thereby make the cleansing solution and the high-pressure air be heated separately from each other at the heating means 30 in the course of passing through the respective transporting pipes 14, 44.

When the work for drying the cleansing solution stained on the parts is to be performed after the completion of the cleansing work, it is constructed that the operation of the high-pressure emitting means 20 in the drum 12 is stopped to thereby prevent the in-flow of the cleansing solution into the heating means 30, and only allow the high-pressure air to pass through the heating means 30.

In this instance, since the high-pressure air flows only through the transporting pipe 44 for the high-pressure air installed separately from the transporting pipe 14 for the cleansing solution, separate control valve is not require to control the flow of the high-pressure air in the course of changing from the cleansing work into the drying work.

As described above, the high-pressure air heated in the heating means 30 is injected through the injection nozzle to thereby dry the cleansing solution stained on the parts.

According to the present embodiment, it is possible to quickly perform the transformation from the cleansing work into the drying work since the cleansing solution and the high-pressure air can be transported to pass through the heating means 30 via separate transporting pipes, and it is another feature of the present embodiment that separate piping is not required to connect between the transporting pipe 14 for the cleansing solution and the transporting pipe for the high-pressure air.

The cleansing solution injected into the cleansing chamber 16 during the cleansing work is recovered into the drum 12 through the discharge-hole 18 formed at the bottom of the cleansing chamber 16, and the impurities are filtered by a filtering screen 18*a* installed at the discharge-hole 18.

While the present invention has been described with reference to the preferred embodiments, the present invention is not limited by the embodiments. It is to be understood that those skilled in the art can change or modify the embodiments without departing from the scope and spirit of the present invention. However, such variations and modifications are all pertained to the scope of the present invention.

What is claimed is:

1. An apparatus for cleaning an article comprising:

a solution receptacle for storing cleaning solution;

a cleaning chamber for receiving an article to clean with the cleaning solution;

a material transporting conduit including a solution conduit connected between the solution receptacle and the cleaning chamber for transporting the cleaning solution from the solution receptacle to the cleaning chamber to apply to the article received in the cleaning chamber for cleaning, the material transporting conduit further including an air conduit connected to a high-pressure air source for transporting the high-pressure air therethrough and to apply to the article; and a heating device coupled with a portion of the solution conduit and a portion of the air conduit, which portions being disposed adjacent to each other, for heating both the cleaning solution in the solution conduit and the high-pressure air in the air conduit concurrently and to a heated temperature prior to applying to the article, wherein the heating device includes a body portion with thermal medium received therein, and a heater adapted to heat the thermal medium, and the portions of the solution conduit and the air conduit coupled with the heating device are each configured in spiral shapes that are received in the thermal medium of the heating device, and wherein the spiral shape of the coupling portion of the air conduit has more turns than the spiral shape of the coupling portion of the solution conduit.

2. The apparatus according to claim 1, further comprising:

an auxiliary conduit coupled to the material transporting conduit for bypassing the transportation of the cleaning solution and the high-pressure air to guide directly to the cleaning chamber without heated by the heating device; and a plurality of control valves coupled to the material transporting conduit and the auxiliary conduit for controlling the transportation passage of the cleaning solution and the high-pressure air between the material transporting conduit and the auxiliary conduit such that the cleaning solution and the high-pressure air can be selectively applied to the article either in a heated state or in an unheated state.

3. The apparatus according to claim 2, wherein the auxiliary conduit includes an auxiliary solution conduit for said bypassing the transportation of the cleaning solution and to guide it directly to the cleaning chamber without heated by the heating device, and an auxiliary air conduit for said bypassing the transportation of the high-pressure air and to guide it directly to the cleaning chamber without heated by the heating device.

4. The apparatus according to claim 1, wherein the heater includes a positive temperature coefficient (PTC) heating element.

5. The apparatus according to claim 1, further comprising a first nozzle connected to a distal end of the solution conduit and a second nozzle connected to a distal end of the air conduit to apply the solution and the high-pressure air separately.

6. The apparatus according to claim 1, further comprising a ventury-type nozzle with one port connected to a distal end of the solution conduit and another port connected to a distal end of the air conduit, to apply the solution and the high-pressure air in a mixed state.

7. The apparatus according to claim 6, further comprising a shut-off device for selectively shutting-off the flow path of the air conduit upon user's selection.

8. The apparatus according to claim 7, wherein the shut-off device includes a lever to be operated by a finger, a supporting bar, a sealing member coupled with the supporting bar for selectively shutting-off the flow path of the air conduit, and a spring for elastically supporting the supporting bar.

9. The apparatus according to claim 1, wherein the solution receptacle is located at a position higher than the cleaning chamber, and a circulation pipe is connected between the cleaning chamber and the solution receptacle to send the used solution in the cleaning chamber to the solution receptacle by a pump for reuse.

10. The apparatus according to claim 1, wherein the solution receptacle is located below the cleaning chamber, and a discharge hole is disposed on a bottom surface of the cleaning chamber, and the used solution in the cleaning chamber is directly flowed into the solution receptacle through the discharge hole for reuse.

11. The apparatus according to claim 1, wherein the cleaning chamber includes a glove integrally attached to an upper portion of the cleaning chamber to be used by the user to clean the article.

12. The apparatus according to claim 1, wherein the cleaning chamber includes a rotation plate configured to place the article to clean thereon.

13. An apparatus for cleaning an article comprising:

a solution receptacle for storing cleaning solution;

a cleaning chamber for receiving an article to clean with the cleaning solution;

a compressor for providing high-pressure air;

a material transporting conduit including a solution conduit connected between the solution receptacle and the cleaning chamber for transporting the cleaning solution from the solution receptacle to the cleaning chamber to apply to the article received in the cleaning chamber for cleaning, the material transporting conduit further including an air conduit connected to the compressor for transporting the high-pressure air there-through and to apply to the article;

a heating device coupled with a portion of the solution conduit and a portion of the air conduit, which portions being disposed adjacent to each other, for heating both the cleaning solution in the solution conduit and the high-pressure air in the air conduit concurrently and to a heated temperature prior to applying to the article;

an auxiliary solution conduit coupled to the solution conduit of the material transporting conduit for bypassing the transportation of the cleaning solution and to guide it directly to the cleaning chamber without heated by the heating device;

an auxiliary air conduit coupled to the air conduit of the material transporting conduit for bypassing the transportation of the high-pressure air and to guide it directly to the cleaning chamber without heated by the heating device; and a plurality of control valves coupled to the material transporting conduit and the auxiliary conduit for controlling the transportation passage of the cleaning solution and the high-pressure air between the material transporting conduit and the auxiliary conduit such that the cleaning solution and the high-pressure air can be selectively applied to the article either in a heated state or in an unheated state, wherein the heating device includes a body portion with thermal medium received therein, and a heater adapted to heat the thermal medium, and the portions of the solution conduit and the air conduit coupled with the heating device are each configured in spiral shapes that are received in the thermal medium of the heating device, and wherein the spiral shape of the coupling portion of the air conduit has more turns than the spiral shape of the coupling portion of the solution conduit.

* * * * *